US007048136B2

(12) United States Patent
Havens et al.

(10) Patent No.: US 7,048,136 B2
(45) Date of Patent: May 23, 2006

(54) CANISTER LID WITH IMPROVED EVACUATION AND VENT ASSEMBLY

(75) Inventors: Paul W. Havens, Greenville, SC (US); Glynn Clements, Greenville, SC (US)

(73) Assignees: Tilia International, Inc., San Francisco, CA (US); Unimark Plastics, Greer, SC (US)

( * ) Notice: Subject to any disclaimer, the term of this patent is extended or adjusted under 35 U.S.C. 154(b) by 0 days.

(21) Appl. No.: 10/430,481

(22) Filed: May 6, 2003

(65) Prior Publication Data

US 2004/0084450 A1 May 6, 2004

Related U.S. Application Data

(60) Provisional application No. 60/423,844, filed on Nov. 5, 2002.

(51) Int. Cl.
*B65D 51/16* (2006.01)

(52) U.S. Cl. ..... 220/212; 220/231; 220/367.1; 220/203.13; 215/228; 215/260; 215/262; 222/509; 222/518; 251/320; 206/524.8

(58) Field of Classification Search ..... 220/231, 220/367.1, 203.11, 212, 203.13; 215/228, 215/260, 262; 222/518, 509; 206/524.8; 251/320

See application file for complete search history.

(56) References Cited

U.S. PATENT DOCUMENTS 1,328,001 A * 1/1920 Kinsman ..... 220/231
1,346,435 A 7/1920 Worster
1,521,203 A 12/1924 Roehrig
2,173,571 A * 9/1939 Jesnig ..... 137/854
2,224,296 A * 12/1940 Hoffman ..... 215/260
2,270,332 A 1/1942 Osborn, Jr. ..... 137/53
2,270,469 A 1/1942 Osborn, Jr. ..... 137/53
2,406,771 A 9/1946 Hughes ..... 226/82
2,416,900 A 3/1947 Busby ..... 215/56
2,436,849 A 3/1948 Billetter ..... 226/82
2,506,362 A 5/1950 Hofmann ..... 220/24
2,669,176 A * 2/1954 Lazerus ..... 99/472
2,755,952 A 7/1956 Ringen ..... 215/52
2,890,810 A 6/1959 Rohling ..... 220/24
2,966,276 A 12/1960 Hing ..... 215/52
3,055,536 A 9/1962 Dieny ..... 220/44
3,167,202 A 1/1965 Tolciss ..... 215/47
3,320,097 A 5/1967 Sugalski ..... 136/178
3,454,182 A * 7/1969 Morton ..... 220/374
3,511,407 A * 5/1970 Palma ..... 220/203.13
3,584,834 A * 6/1971 Reid et al. ..... 251/321
3,827,596 A 8/1974 Powers, Jr. ..... 220/44
3,851,588 A * 12/1974 Taylor ..... 102/336
3,858,750 A 1/1975 Grall ..... 220/203
3,880,187 A * 4/1975 Kneusel ..... 137/843

(Continued)

OTHER PUBLICATIONS

U.S. Appl. No. 10/081,382, filed Feb. 23, 2002, Anderson et al.

(Continued)

*Primary Examiner*—Nathan J. Newhouse
*Assistant Examiner*—James Smalley
(74) *Attorney, Agent, or Firm*—Perkins Coie LLP

(57) ABSTRACT

A canister lid includes a cover member adapted to cover a canister, thereby defining an interior of the canister. An evacuation valve is adapted to allow evacuation of the interior of the container. A vacuum release valve is adapted to allow venting of the interior of the container.

32 Claims, 9 Drawing Sheets

U.S. PATENT DOCUMENTS 3,924,774 A 12/1975 Donnelly ..... 220/93
4,016,999 A 4/1977 Denzer ..... 220/231
4,051,971 A 10/1977 Saleri et al. ..... 215/260
4,059,113 A 11/1977 Beinsen et al.
4,143,787 A 3/1979 Walker ..... 220/203
4,149,650 A 4/1979 Whelchel et al. ..... 220/201
4,177,831 A * 12/1979 Benjamin ..... 137/513.5
4,222,276 A 9/1980 DeRogatis ..... 73/714
4,249,583 A 2/1981 Lundbladh ..... 141/65
4,278,114 A 7/1981 Ruberg ..... 141/65
4,349,118 A 9/1982 Sanderson ..... 220/201
4,372,096 A 2/1983 Baum ..... 53/88
4,440,316 A * 4/1984 Christine ..... 222/83.5
4,442,951 A 4/1984 Nakazawa et al. ..... 220/319
4,452,425 A * 6/1984 Lucking ..... 251/144
4,471,807 A * 9/1984 Lucking et al. ..... 137/614.19
4,475,566 A * 10/1984 Haines ..... 137/68.3
4,624,662 A * 11/1986 Le ..... 604/249
4,625,887 A 12/1986 Ito ..... 220/231
4,660,355 A 4/1987 Kristen ..... 53/510
4,693,400 A * 9/1987 Frahm et al. ..... 222/518
D296,108 S 6/1988 Niedworok ..... D15/146
4,763,802 A * 8/1988 Johnston ..... 215/228
4,909,014 A 3/1990 Kobayashi et al. ..... 53/86
4,989,745 A 2/1991 Schneider ..... 220/208
5,031,785 A 7/1991 Lemme ..... 215/228
5,050,764 A 9/1991 Voss ..... 220/378
5,121,590 A 6/1992 Scanlan ..... 53/510
5,195,427 A 3/1993 Germano ..... 99/472
5,203,465 A 4/1993 Baumgarten ..... 220/206
5,232,016 A 8/1993 Chun ..... 137/565
5,347,918 A 9/1994 Chen ..... 99/472
5,364,241 A 11/1994 Schultz ..... 417/442
5,390,809 A 2/1995 Lin ..... 220/212
5,397,024 A * 3/1995 Wu et al. ..... 220/231
5,405,038 A 4/1995 Chuang ..... 220/231
5,406,992 A 4/1995 Miramon ..... 141/65
5,439,724 A 8/1995 Rojek ..... 428/66.3
5,445,293 A 8/1995 Schutz ..... 220/319
5,449,079 A 9/1995 Yang ..... 215/228
5,465,857 A 11/1995 Yang ..... 215/228
5,469,979 A * 11/1995 Chiou ..... 215/228
5,481,852 A 1/1996 Mitchell ..... 53/432
5,499,735 A 3/1996 Chen ..... 220/231
5,535,900 A 7/1996 Huang ..... 215/228
5,542,583 A 8/1996 Boyer et al. ..... 222/425
5,546,997 A 8/1996 Miramon ..... 145/65
5,558,243 A 9/1996 Chu ..... 220/212
5,564,480 A 10/1996 Chen ..... 141/65
5,564,581 A 10/1996 Lin ..... 215/228
5,597,086 A 1/1997 King-Shui ..... 220/421
5,611,376 A 3/1997 Chuang ..... 141/65
5,617,893 A 4/1997 Webster ..... 137/526
5,638,971 A 6/1997 Justesen ..... 215/228
5,651,470 A 7/1997 Wu ..... 220/212
5,653,352 A * 8/1997 Kim ..... 215/228
5,692,632 A 12/1997 Hsieh et al. ..... 215/212
5,697,510 A 12/1997 Wang et al. ..... 215/262
5,735,317 A 4/1998 Wu ..... 141/65
5,765,608 A 6/1998 Kristen ..... 141/198
D395,984 S 7/1998 Yang ..... D7/591
5,779,082 A 7/1998 Miramon ..... 220/212
5,803,282 A 9/1998 Chen et al. ..... 215/228
5,806,575 A 9/1998 Tsay ..... 141/65
5,806,704 A 9/1998 Jamison ..... 220/212
5,941,391 A 8/1999 Jury ..... 206/524.8
5,944,211 A 8/1999 Woodnorth et al. .... 220/203.13
5,957,317 A * 9/1999 Lee ..... 220/212
5,960,837 A 10/1999 Cude ..... 141/65
5,971,180 A 10/1999 Wu ..... 215/228
5,974,686 A 11/1999 Nomura et al. ..... 34/263
5,979,688 A 11/1999 Stodd ..... 220/231
5,992,666 A * 11/1999 Wu ..... 220/212
6,035,769 A 3/2000 Nomura et al.
6,044,756 A 4/2000 Chang ..... 99/472
6,045,011 A 4/2000 Yang ..... 222/401
6,131,753 A 10/2000 Lynch ..... 215/228
6,148,875 A 11/2000 Breen ..... 141/65
6,161,716 A 12/2000 Oberhofer et al. ..... 220/203.04
6,206,220 B1 3/2001 Stodd ..... 220/231
6,253,947 B1 7/2001 Yang ..... 220/324
6,375,024 B1 4/2002 Park ..... 215/262
6,401,752 B1 * 6/2002 Blackbourn et al. ..... 137/588
6,435,382 B1 * 8/2002 Giblin et al. ..... 222/509
6,470,910 B1 * 10/2002 Blackbourn et al. ..... 137/588
6,619,493 B1 9/2003 Yang ..... 215/228
6,644,489 B1 * 11/2003 Chang ..... 220/203.01
6,648,186 B1 * 11/2003 Roethel et al. ..... 222/509
6,789,690 B1 * 9/2004 Nieh et al. ..... 220/231
6,896,158 B1 * 5/2005 Leray et al. ..... 222/145.1
2003/0197011 A1 * 10/2003 Nieh et al. ..... 220/231

OTHER PUBLICATIONS

U.S. Appl. No. 10/174,267, filed Jun. 18, 2002, Nieh et al.

* cited by examiner

CANISTER LID WITH IMPROVED EVACUATION AND VENT ASSEMBLY

RELATED APPLICATION

This application includes subject matter that is related to commonly assigned U.S. patent application Ser. No. 10/174,267, filed on Jun. 18, 2002, which is incorporated herein by reference.

FIELD OF THE INVENTION

The present invention relates to a canister lid that forms an airtight seal with a canister body and allows evacuation and venting of the canister.

BACKGROUND

Food products, whether liquid or dry, spoil fairly quickly and can emit odors. Lids and storage devices have been developed for use with food storage containers that seal outside air from the goods stored within the container.

Vacuum sealing of perishables in the home and kitchen is becoming more popular as people increasingly become aware of the health benefits of the natural and healthy foods. Such foods, that do not contain preservatives, lose their freshness quickly. Storing foods in a vacuum sealed canister is a non-chemical way to help preserve the freshness of the food. Vacuum packing has the added benefit of evacuating the air from within the container as well as sealing off the outside air. Such packing increases storage life and eliminates odors. A simple, easy-to-use system for household use that allows goods to be vacuum packed would be advantageous.

Most available vacuum sealers are not particularly well suited for home use with rigid containers because they rely on hand pumps to pull a vacuum, or there must be an adapter that connects a vacuum hose to the canister lid. Accordingly, it would be advantageous if the vacuum hose could directly engage and mate with the canister lid to create a vacuum within the canister. It would also be advantageous if a canister lid, that enabled a vacuum hose to directly engage it, were simple and inexpensive to produce and assemble.

SUMMARY OF SOME OF THE ASPECTS OF THE PRESENT INVENTION

Embodiments of the present invention are directed to a canister lid that includes an evacuation and venting assembly. Embodiment of the present invention are also directed to the evacuation and venting assembly, and components thereof.

In accordance with an embodiment of the present invention, a canister lid includes a cover member adapted to cover a canister, thereby defining an interior of the canister. The canister lid also includes an evacuation valve and a vacuum release valve. The evacuation valve is adapted to allow evacuation of the interior of the container. The vacuum release valve is adapted to allow venting of the interior of the container.

According to an embodiment of the present invention, a housing is attached to an underside of the cover member. An interior of the housing and the underside of the cover member define a chamber. A first opening and a second opening in the cover member provide access into the chamber through the cover member. A third opening and a fourth opening in a bottom of the housing provides access from the interior of the canister into the chamber through the bottom of the housing. In accordance with an embodiment of the present invention, at least one satellite opening extends through the bottom of the housing, near the fourth opening.

In accordance with an embodiment of the present invention, an evacuation valve includes a stem portion and a top portion having a flexible periphery that extends beyond the stem portion. The stem fits into the fourth opening such that the flexible periphery covers each satellite opening. In an alternative embodiment, rather than having (or in addition to having) at least one satellite opening, the fourth opening can be shaped such that a portion of it extends beyond the stem, but not beyond the flexible periphery. In such an embodiment, when the stem fits into the fourth opening, the flexible periphery covers the portion of the fourth opening extending beyond the stem.

A vacuum release valve, according to an embodiment of the present invention, includes a head the extends above the first opening, abase the extends below the third opening, and an elongated stem that extends between the head and the base. The head includes a flexible downwardly angled periphery that extends beyond the first opening, thereby keeping the head above the first opening. The base has a periphery that extends beyond the third opening. The flexible downwardly angled periphery of the head of the vacuum release valve provides sufficient biasing so that the periphery of the base is predisposed to seal the third opening.

In an embodiment of the present invention, when a vacuum is pulled through the second opening, the flexible periphery of the evacuation valve is lifted away from the bottom of the housing to allow air to be evacuated through the at least one satellite opening (and/or through the portion of the fourth opening that extends beyond the stem), around the flexible periphery, into the chamber, and out through the second opening. The flexible periphery of the evacuation valve covers each satellite opening (and/or the portion of the fourth opening that extends beyond the stem) after a vacuum is formed in the interior of the canister. Further, in additional to the flexible periphery of the evacuation valve covering each satellite opening (and/or the portion of the fourth opening that extends beyond the stem), the base of the vacuum release valve seals the third opening to retain the vacuum formed in the canister.

In an embodiment of the present invention, the flexible downwardly angled periphery of the vacuum release valve flexes when a downward force is applied (e.g., by a finger of a user), thereby causing the base to move downward and a gap to form between the third opening and the vacuum release valve. This gap allows air to enter the interior of the canister when the pressure within the interior of the canister is lower than ambient pressure.

In accordance with an embodiment of the present invention, the head, base and elongated stem of the vacuum release valve are integrally formed, for example, from rubber and/or an elastomeric material.

In accordance with an embodiment of the present invention, the cover member, the housing, the vacuum release valve and the evacuation valve are each integrally formed. This results in a lid that has relatively few parts, and thus, a lid with parts that are relatively inexpensive to produce and assemble. Such a lid is also relatively simple, reducing the likely hood that the lid will break and/or fail to operate properly.

Further features, aspects, and advantages of embodiments of the present invention will become more apparent from the detailed description set forth below, the drawings and the claims.

DETAILED DESCRIPTION OF THE PRESENT INVENTION

Figure 1A:
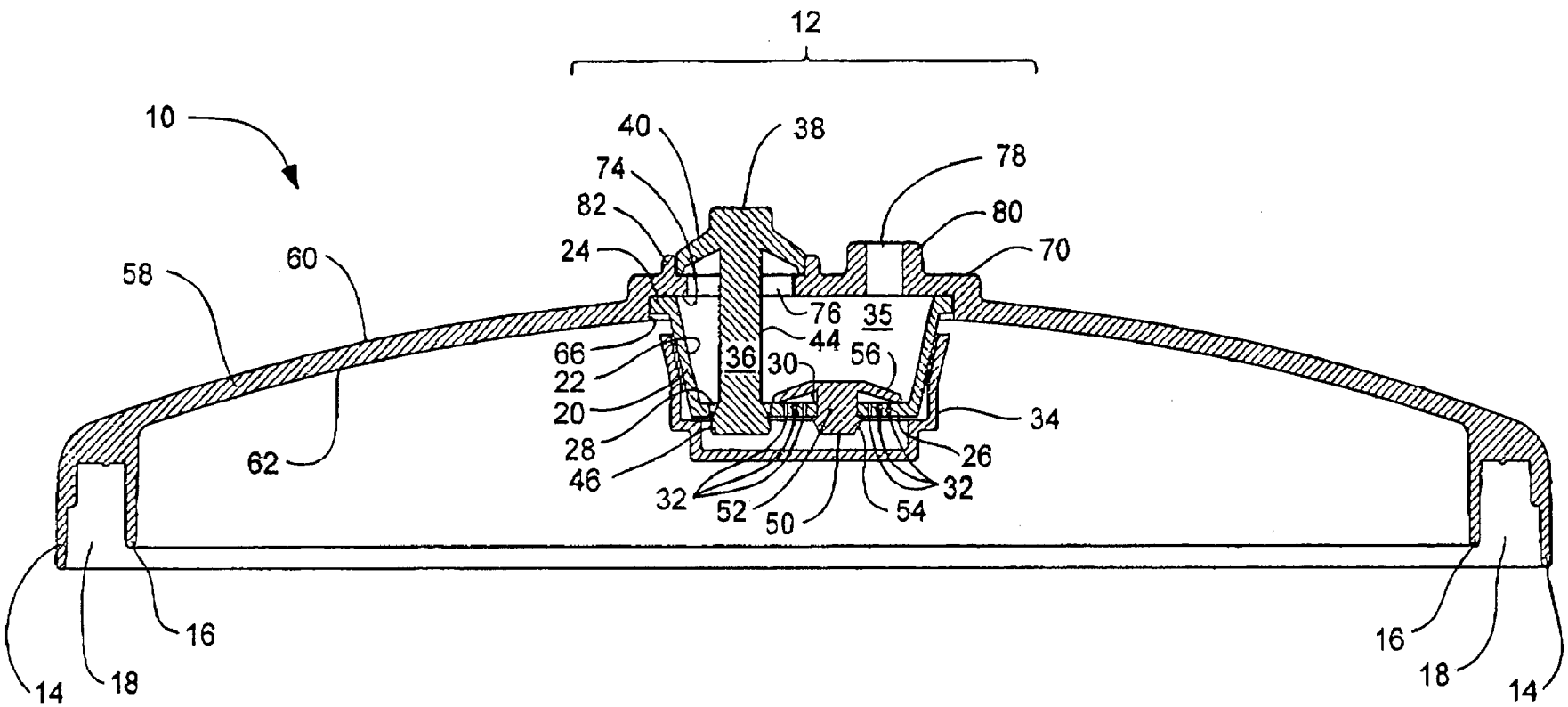
FIG. 1A is a cross-sectional view of a canister lid, according to an embodiment of the present invention.
Figure 1B:
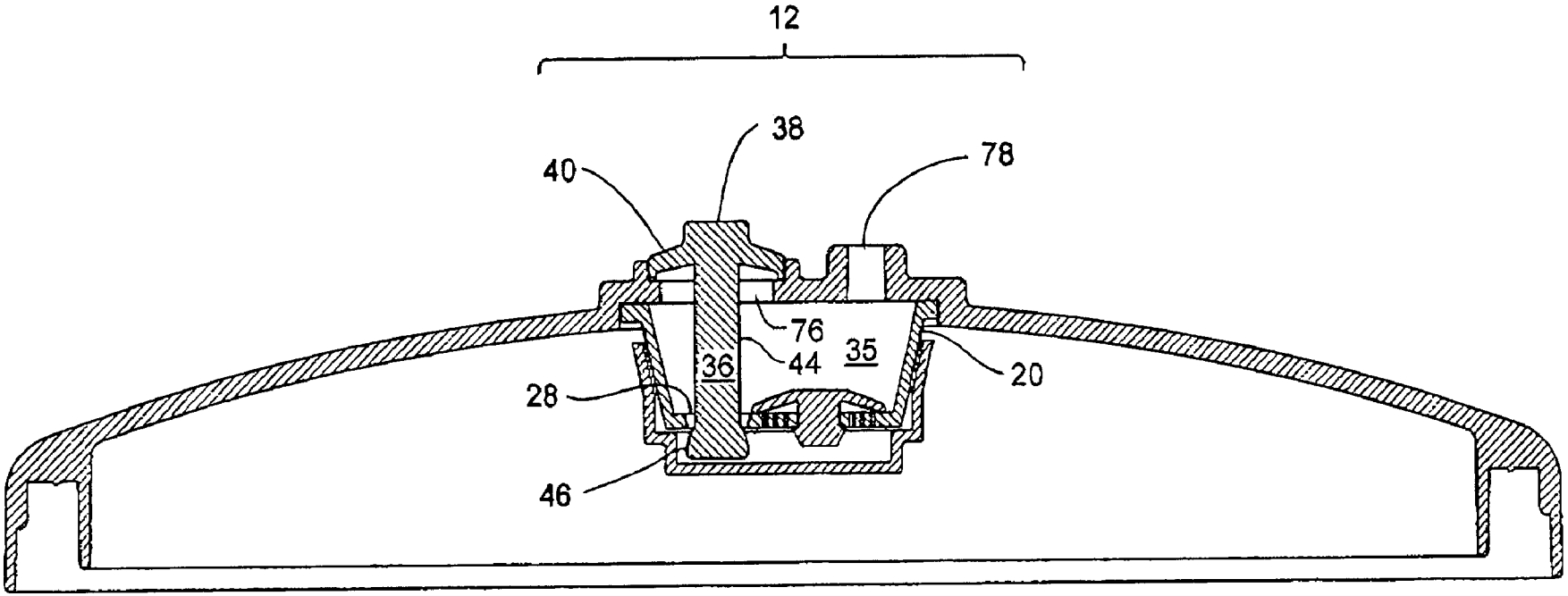
FIG. 1B is the same cross-sectional view as FIG. 1A, with the vacuum release valve pushed down.
Figure 2:
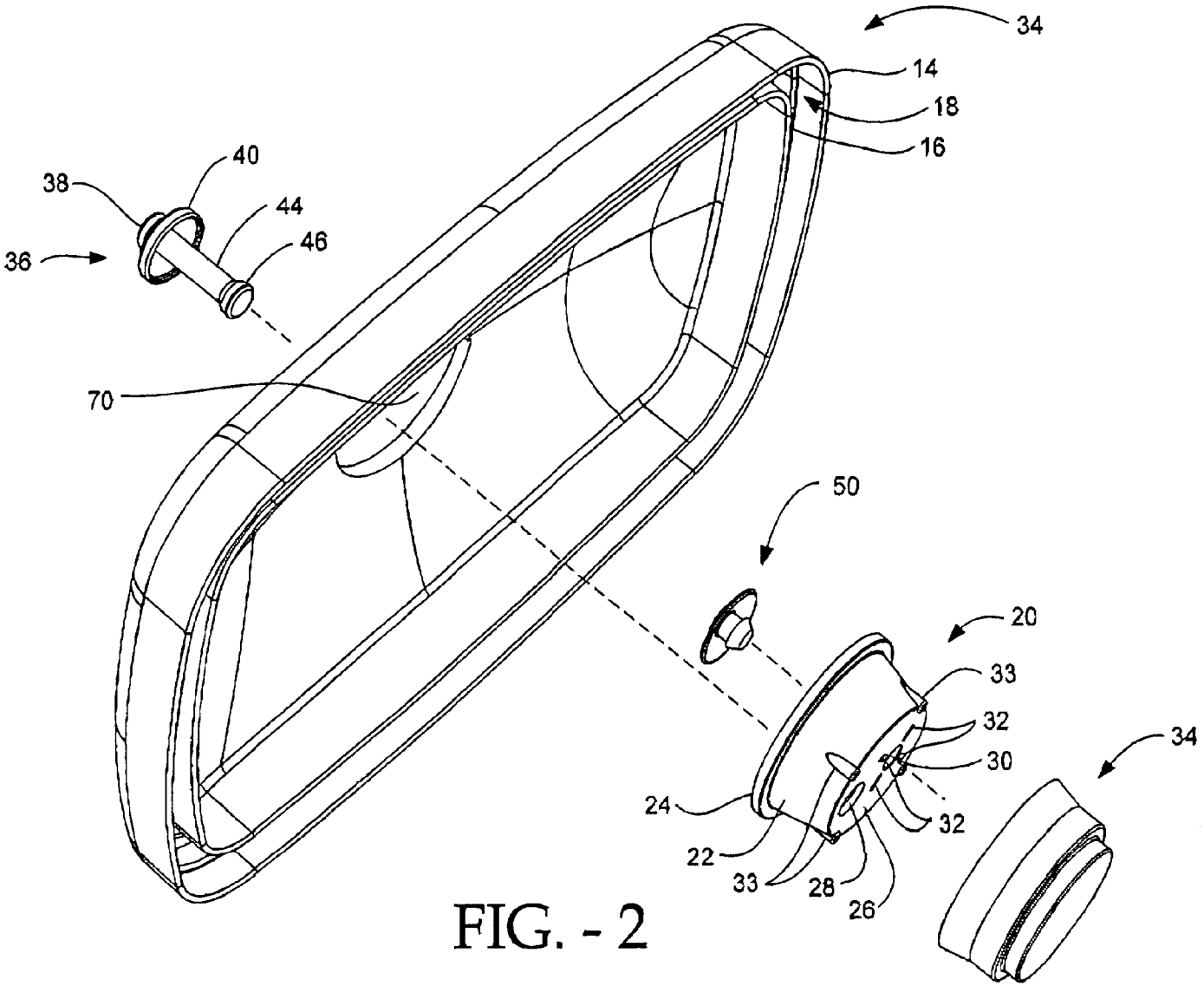
FIG. 2 is an exploded view of the embodiment shown in FIGS. 1A and 1B.

FIGS. 1A, 1B and 2 illustrate cross-sectional views and an exploded view of a canister lid 10, according to an embodiment of the present invention. Canister lid 10 includes a cover member 58 that has an upper or outer surface 60, and a lower or inner surface 62. Cover member 58 can be made of various plastic materials, as is known in the industry. An outer periphery of lid 10 includes an outer peripheral lip 14 and an inner peripheral lip 16, which form a peripheral channel 18 therebetween. This outer periphery enables lid 10 to engage a peripheral edge of a corresponding canister, thereby defining an interior of the canister (the terms "canister" and "container" are used interchangeably herein). A gasket (not shown) can be placed within the peripheral channel 18 to improve the seal formed between lid 10 and the canister. This is just an example of an outer periphery of lid 10. Accordingly, other outer peripheries that enable lid 10 to engage a canister are within the spirit and scope of the present invention. Lid 10 includes a evacuation and venting assembly that is designated generally as 12. Evacuation and venting assembly 12 enables the evacuation of a canister (covered by lid 10) and the venting of the canister, as will be described in detail below.

Figure 7A:
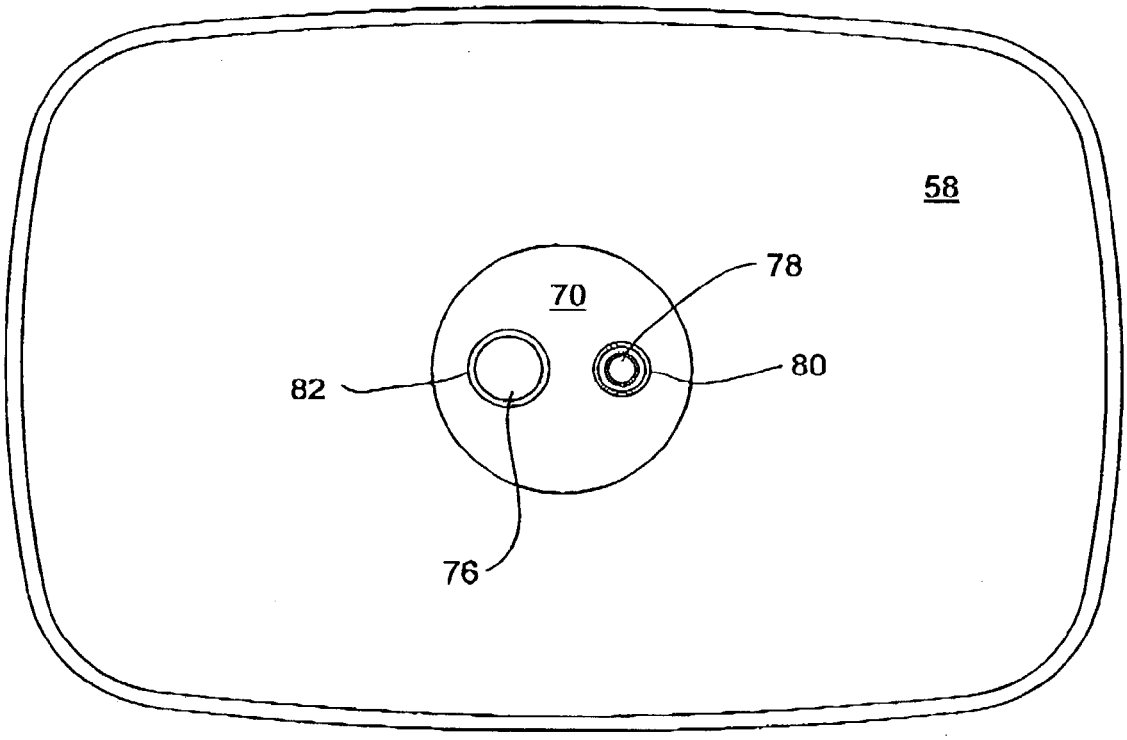
FIG. 7A is a top view of the cover member shown in FIGS. 1A, 1B and 2.
Figure 7B:
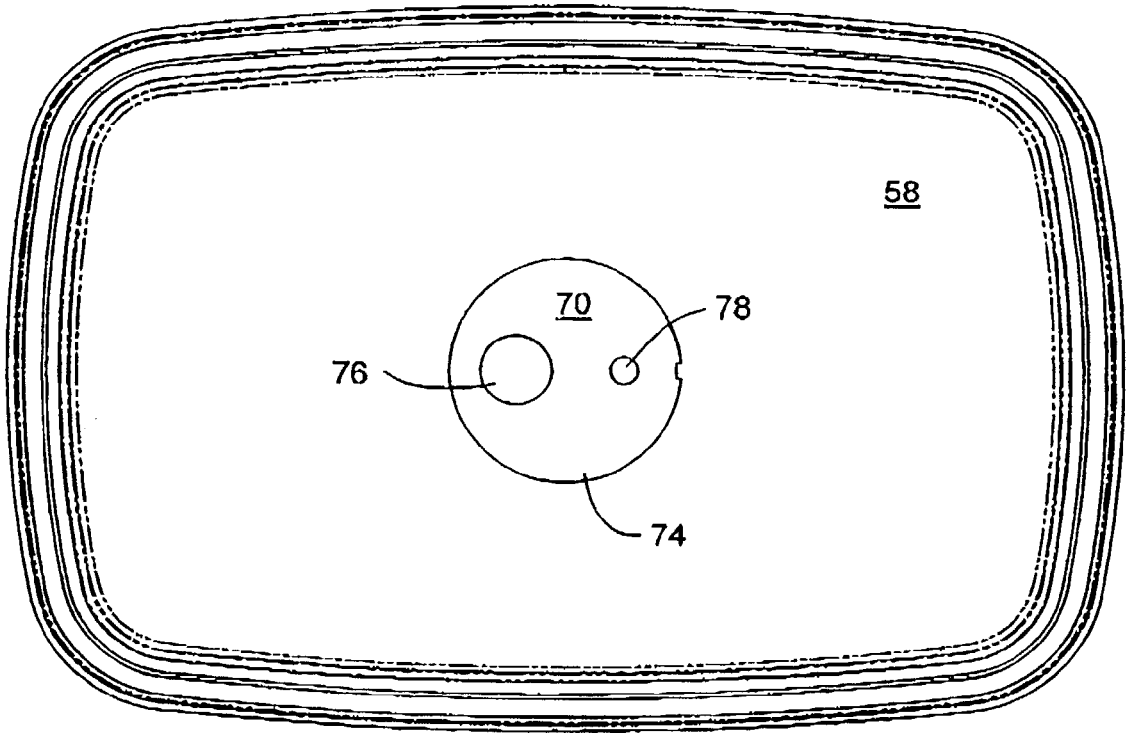
FIG. 7B is a bottom view of the cover member of FIG. 7A.

FIGS. 7A and 7B are, respectively, top and bottom views of cover member 58. Cover member 58 is shown as having a generally rectangular shape when viewed from the top or bottom, although other shapes (e.g., circular, square or oval) are within the spirit and scope of the present invention.

In accordance with an embodiment of the present invention, lid 10 includes a raised portion 70, shown as being located in the center of cover member 58. Cover member 58 is shown as being substantially smooth and continuous and as having a convex or dome shape. The convex or dome shape is useful to raise evacuation and venting assembly 12, so that assembly 12 does not reduce the volume of the canister. Further, the convex or dome shape of cover member 58 increases the strength of member 58 so that it does not collapse when a vacuum is formed within the interior of the container. When in the center, raised portion 70 is at a highest point of lid 10. However, raised portion 70 need not be located in the center. As can be seen in FIGS. 2, 7A and 7B, raised portion 70 is shown as having a round shape. However, raised portion 70 can have other configurations, such as, but not limited to, square, rectangular or oval.

Raised portion 70 includes two openings that extend therethrough, including a release valve support opening 76 and a vacuum port opening 78. In accordance with an embodiment of the present invention, vacuum port opening 78 includes a collar 80 that protrudes from a top of raised portion 70 and surrounds the opening. Collar 80 is useful as an interface between lid 10 and a hose (not shown) connected to a vacuum pump (not shown). More specifically, the end of the hose fits over collar 80 to form an airtight seal with collar 80.

Located adjacent vacuum port opening 78 is release valve support opening 76. In accordance with an embodiment of the present invention, a collar 82 surrounds release valve support opening 76 to help keep vacuum release valve 36 in its proper position, as shown in FIGS. 1A and 1B.

A housing 20 is secured to lower surface 62 of cover member 58 (e.g., using ultrasonic welding), below raised portion 70. More specifically, an underside of raised portion 70 defines a step or well including adjacent and substantially perpendicular surfaces 66 and 74. Housing 22 includes a side wall 22 (shown as being tapered, but not so limited), a bottom 26, and a rim 24. Rim 24 is preferably sized and configured to fit into the well under raised surface 70 in such a way that housing 20 is properly aligned, as will be explained in more detail below. A top of rim 24 is preferably flush against interior surface 62 of lid 10 (and more specifically against underside 74 of raised portion 70). In general, it is important for housing 20 to form an airtight seal with cover member 58. This prevents air from leaking into a canister (covered by lid 10) after a vacuum is produced within the canister.

Figure 3A:
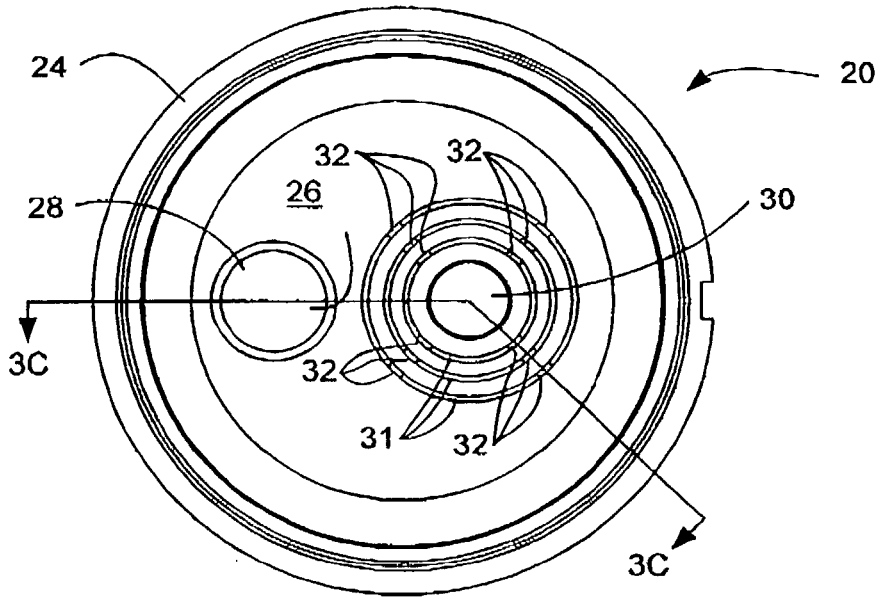
FIG. 3A is a top view of the housing portion shown in FIGS. 1A, 1B and 2.
Figure 3B:
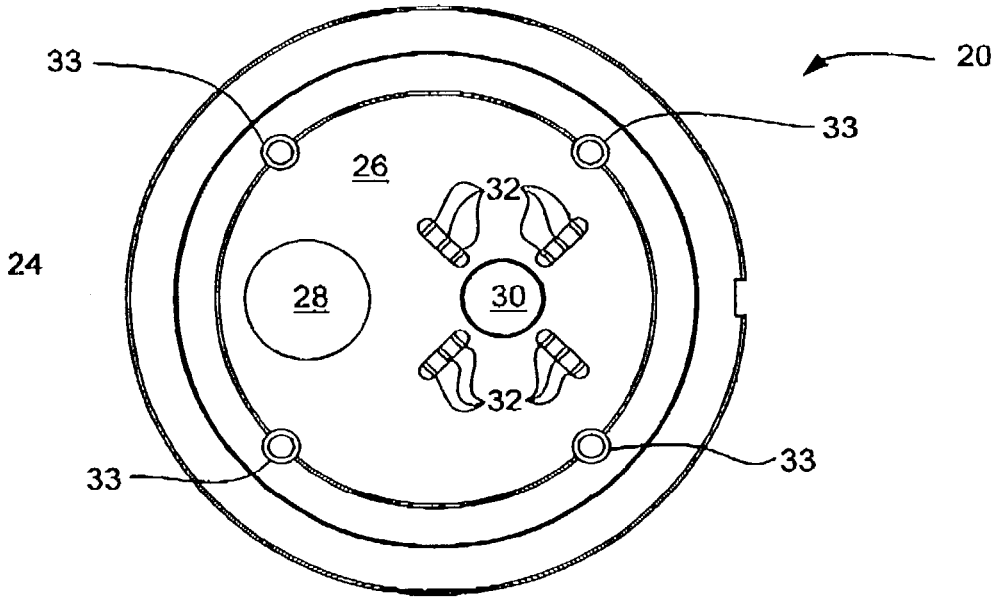
FIG. 3B is a bottom view of the housing shown in FIG. 3A.
Figure 3C:
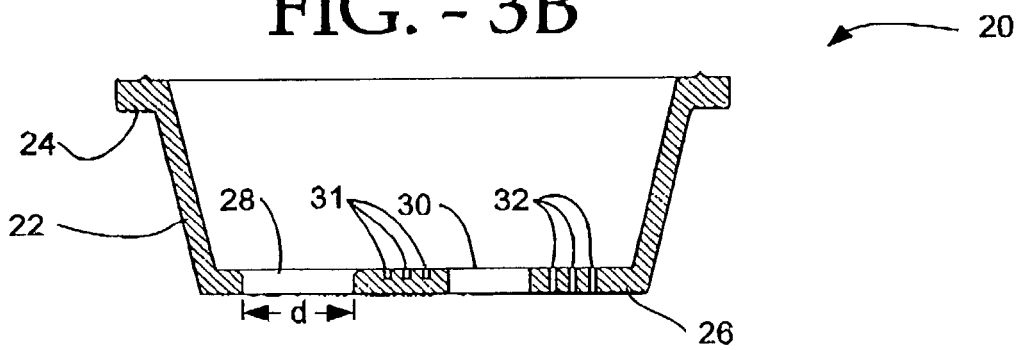
FIG. 3C is a cross-sectional view of the housing shown in FIGS. 3A and 3B.

Additional details of housing 20 are shown in FIG. 2, and in FIGS. 3A–3C. Side wall 22 is shown as being generally cylindrical with a slight taper, however can have other configurations. In the embodiment shown, the overall shape of housing 20 is cup-like. However, housing 20 can have other configurations (e.g.,box like), and need not be circular when viewed from the top or bottom. Referring to FIGS. 3A–3C, bottom 26 includes two openings that extend therethrough, including a vent opening 28 (also referred to as release opening 28) and evacuation valve opening 30. Housing 20 should be attached to the underside of cover member 58 such that release valve support opening 76 is substantially aligned with vent opening 28, as best seen in FIGS. 1A and 1B.

Figure 3D:
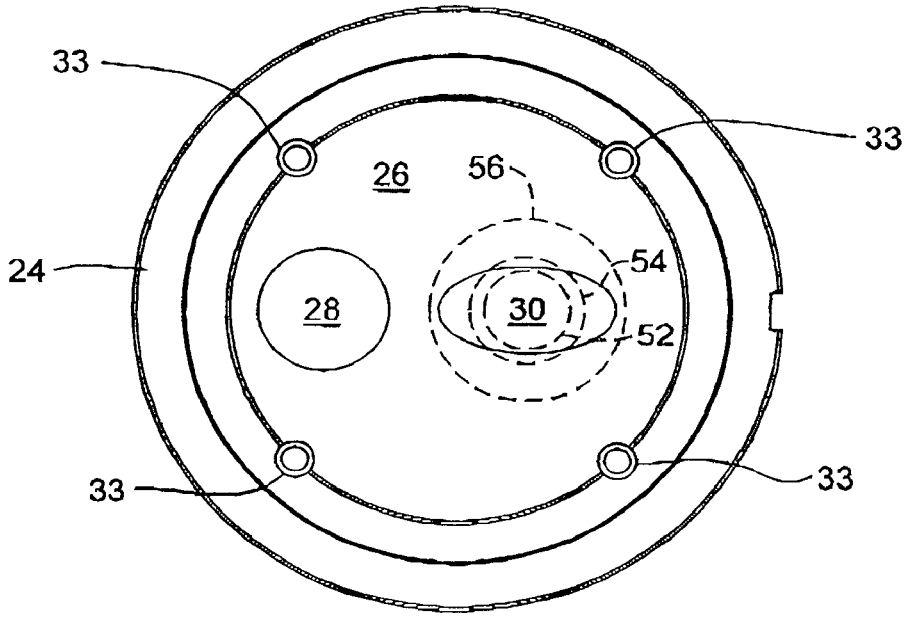
FIG. 3D is a bottom view of the housing, according to an alternative embodiment of the present invention.
Figure 3E:
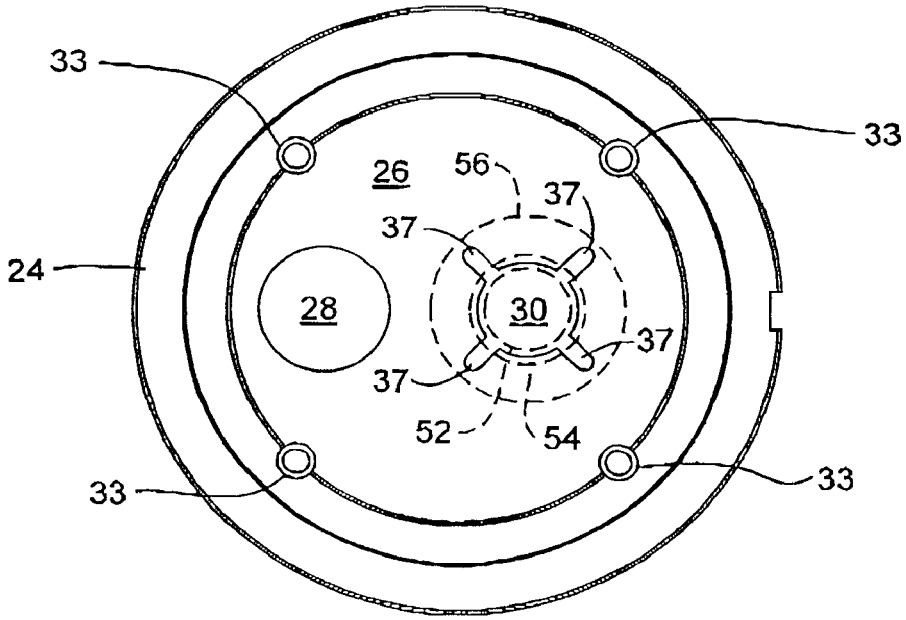
FIG. 3E is a bottom view of the housing, according to another alternative embodiment of the present invention.

Located close to evacuation valve opening 30, is one or more satellite openings 32 that extend through bottom 26. Satellite openings 32 are shown as being located within circular grooves 31 that surround evacuation valve opening 30. Circular grooves 31 help direct air through satellite openings 32 during the evacuation process, described in more detail below. Twelve satellite openings 32 are shown in FIGS. 3A and 3B. However, it is within the spirit and scope of the present invention to have fewer, or a greater number of, satellite openings 32. Instead of (or in addition to) having one or more satellite openings 32, evacuation valve opening 30 can be shaped such that air from within a canister can travel around stem 52 (rather than, or in addition to, through satellite openings 32), and around flexible periphery 56, when a vacuum is pulled through vacuum port opening 78 causing flexible periphery 56 of evacuation valve 50 to be lifted away from bottom 26. For example, in one embodiment, opening 30 can be oval, as shown in FIG. 3D. In this embodiment at least a portion of the oval opening extends beyond stem 52 and stopper 54 (each shown in dashed line) of evacuation valve 50, but does not extend beyond flexible periphery 56 (also shown in dashed line) of evacuation valve 50. In another exemplary embodiment, shown in FIG. 3E, opening 30 includes one or more channels portions 37 that extend beyond stem 52 and stopper 54 of evacuation valve 50, but do not extend beyond flexible periphery 56 of evacuation valve 50.

Housing 20 is preferably manufactured from a single piece of material, and may or may not be manufactured from the same plastic material used to produce cover member 58. As best seen in FIGS. 2 and 3B, an outer surface of housing 20 includes spacers 33, the purpose of which shall be described below. For convenience, satellite openings 32 are shown as being along a same horizontal line as openings 28 and 30, but need not be, as shown in FIGS. 3A and 3B.

Figure 6A:
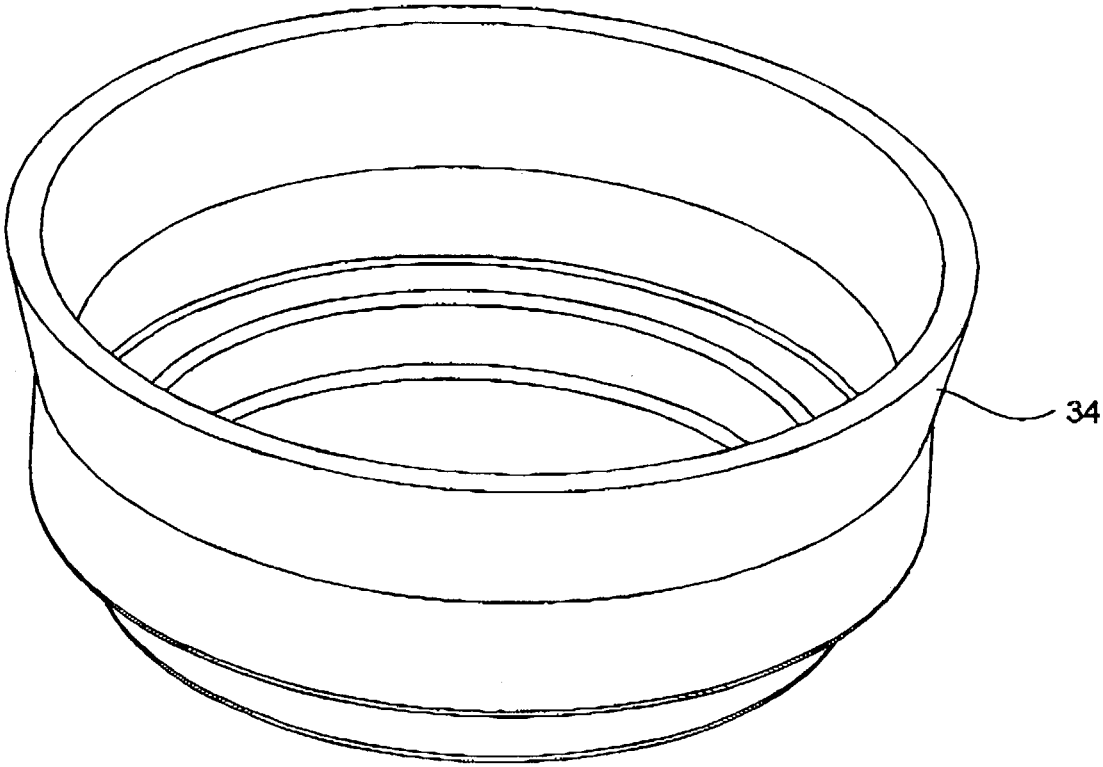
FIG. 6A is a perspective view of the safety cap portion shown in FIGS. 1A, 1B and 2.
Figure 6B:
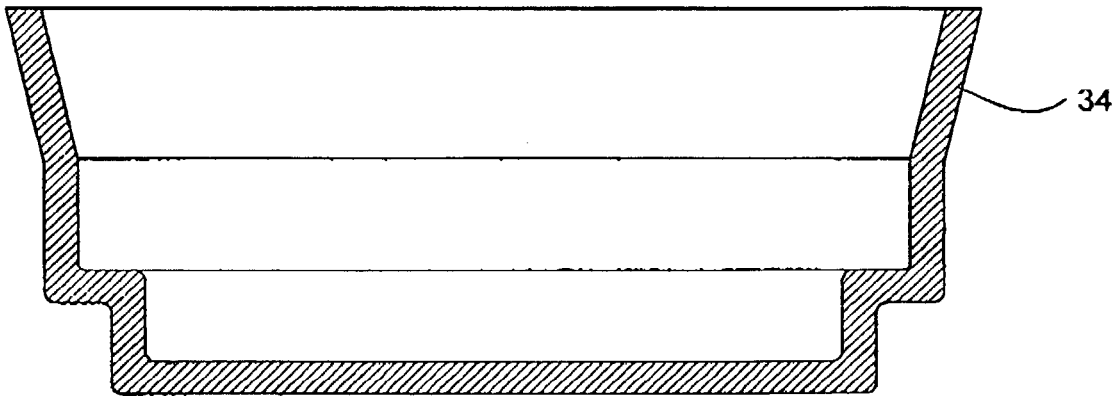
FIG. 6B is a cross-sectional view of the cap of FIG. 6A.

An optional safety cap 34 is pressed fit onto housing 20. Cap 34 allows air to be evacuated from the canister, and vented back into the canister, yet assists in keeping liquid and other container contents from being drawn into chamber 35. That is, cap 34 is placed over housing to assist in preventing liquids or other contents from entering satellite openings 32 during evacuation and/or vent opening 28 during venting. Spacers 33, best seen in FIGS. 2 and 3B, ensure that a gap is maintained between an inner surface of cap 34 and the outer surfaces of side wall 22 and bottom 26 of housing 20. Cap 34 allows a person to fill the canister with more liquid or other contents than if cap 34 were not placed over housing 20. Additional views of safety cap 34 are shown in FIGS. 6A and 6B.

Figure 4A:
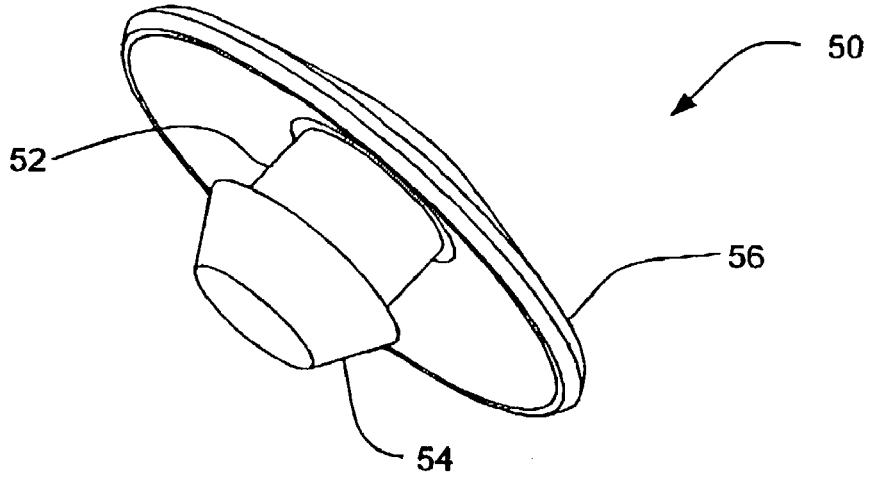
FIG. 4A is a perspective view of an evacuation valve, according to an embodiment of the present invention.
Figure 4B:
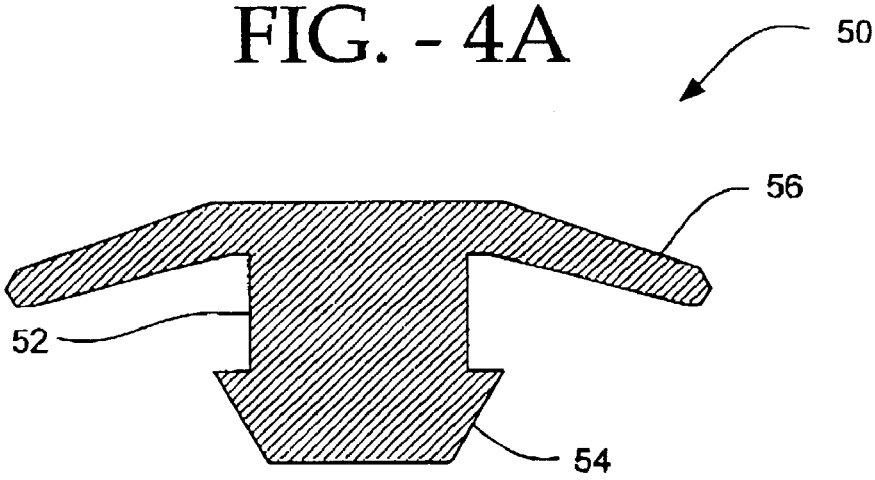
FIG. 4B is a cross-sectional view of the evacuation valve of FIG. 4A.
Figure 4C:
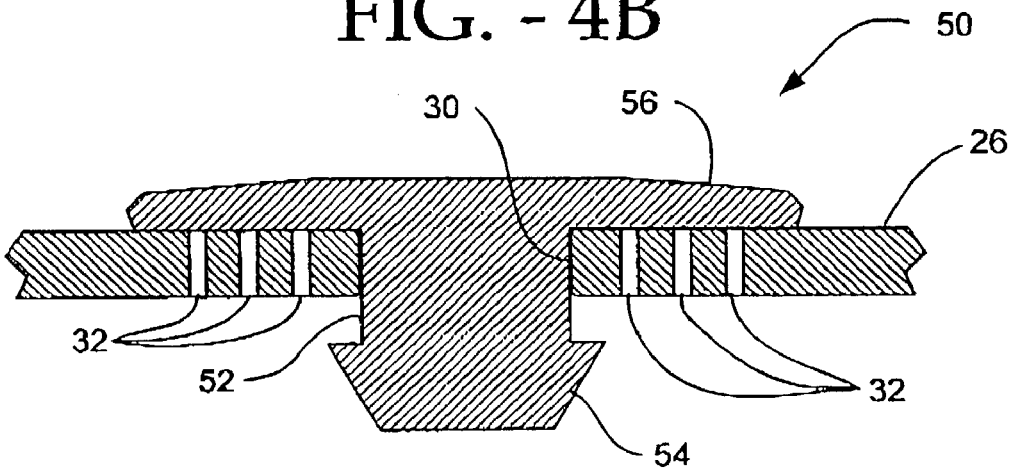
FIG. 4C is a cross-sectional view of the evacuation valve of FIGS. 4A and 4B, and a portion of the bottom of the housing of FIGS. 3A–3C, when the flexible peripheral portion of the valve is substantially flattened.

Referring back to FIG. 1A, an evacuation valve 50 controls the airflow through satellite openings 32. Additional views of vacuum valve 50 are shown in FIGS. 4A–4C. Evacuation valve 50 includes a stem 52, a keeper or flange portion 54 and a head 56 that includes a flexible periphery that extends outward and downward from a top of stem 52. In accordance with an embodiment, evacuation valve 50 is manufactured from a single piece of rubber and/or elastomeric material. During assembly of lid 10, prior to housing 20 being attached to the under side of cover member 58, stem 52 is inserted through evacuation valve opening 30. Once inserted through opening 30, flange or stopper 54 prevents valve 50 from becoming dislodged during the evacuation process.

A vacuum release valve 36 controls the airflow through vent opening 28. Vacuum release valve 36 includes an elongated stem 44, a base 46, and a head 38, which includes a flexible downwardly projecting periphery 40. In accordance with an embodiment, vacuum release valve 36 is manufactured from a single piece of rubber and/or elastomeric material.

Figure 5:
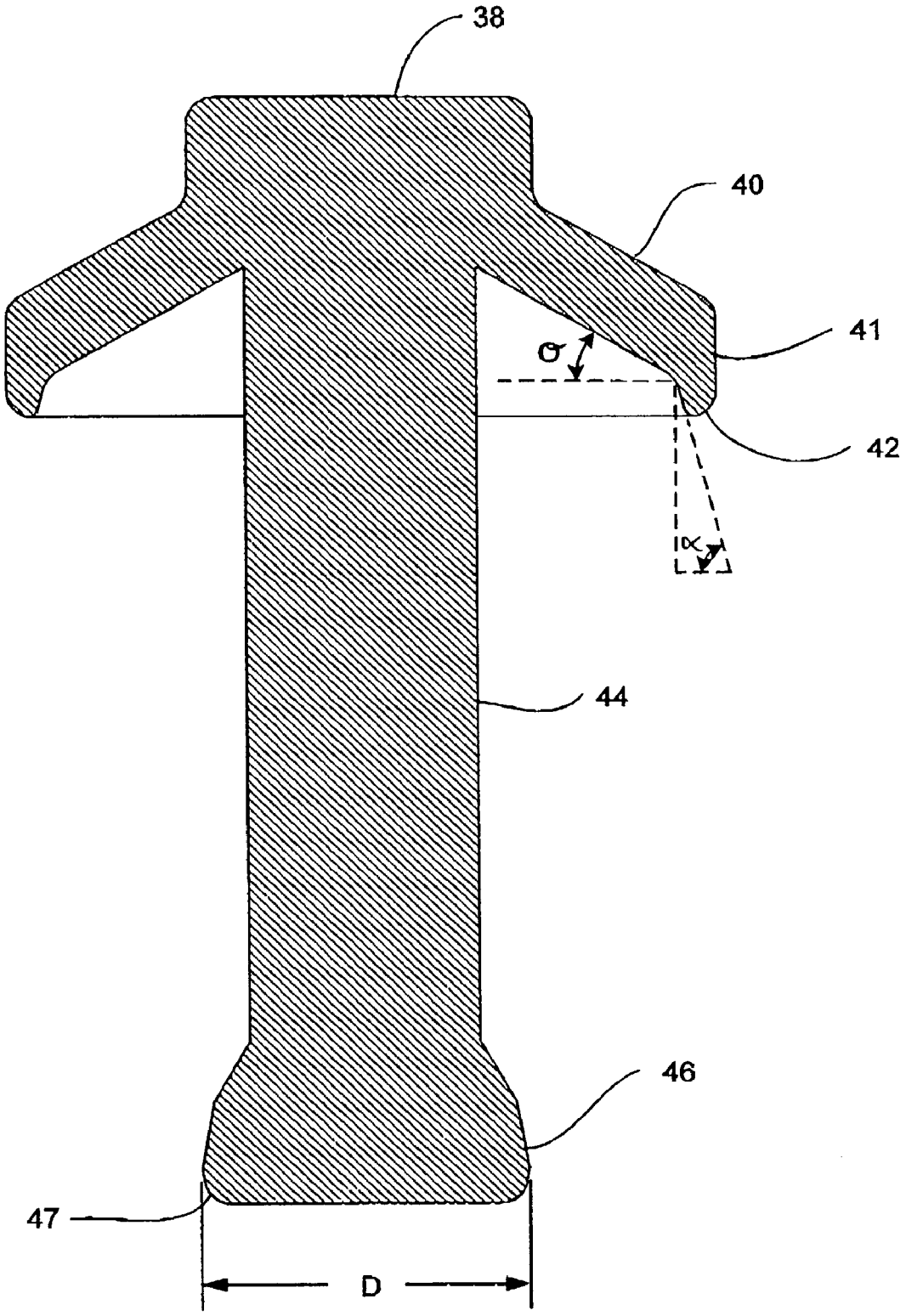
FIG. 5 is a cross-sectional view of the vacuum release valve, according to an embodiment of the present invention.

Additional details of vacuum release valve 36 are now described with reference to FIG. 5. According to an embodiment of the present invention, an angle θ between downwardly projecting periphery 40 and the top surface of raised portion 70 is between about 30 degrees and 60 degrees, and preferably about 40 degrees. An outer distal end 41 of downwardly projecting periphery 40 is flat, according to an embodiment of the invention, allowing it to rest flush against an inner wall of collar 82, as shown in FIG. 1A. A rounded rib 42 projects downward from distal end 41 at an angle α (with respect to the top surface of raised portion 70) that is steeper than θ. Rounded rib 42 acts as a fulcrum to assist in the bending of downwardly projecting periphery 40.

Base 46 gradually tappers outward from elongated stem 44 such that it is wider than stem 44. A lower outer edge 47 of base 46 is preferably rounded, as best seen in FIG. 5. A diameter D of the widest portion of base 46 (shown in FIG. 5) is slightly larger than a diameter d of release opening 28 (shown in FIG. 3C). For example, diameter D is about 0.015 inches larger than diameter d. As shown in FIG. 3C, the upper diameter of opening 28 is chamfered or tapered. During assembly of lid 10, after housing 20 is attached to the under side of cover member 58, release valve 36 is inserted through release valve opening 76 until a bottom of base 46 sits in release opening 28. At that point, downward pressure is asserted on head 38 of release valve 36 until base 46 is forced through release opening 28. Rounded outer edge 47 of base 46 and the chamfered or tapered upper diameter of opening 28 assists in the forcing through of base 46. Further, base 46 is preferably made from a flexible material (as is preferably the rest of release valve 36) to enable it to contract as it is forced through vent opening 28, and then expand back to its original size (with diameter D) after it is forced through opening 28.

When vacuum release valve 36 is in place, as just described above, head 38 of release valve 36 extends above release valve support opening 76, and base 46 (at least a portion thereof) extends below release valve opening 28, as best seen in FIG. 1A. Elongated stem 44 extends between head 38 and base 46, through chamber 35. In accordance with an embodiment, an upper portion of elongated stem 44 that extends through release valve support opening 76 has a circumference that is smaller than opening 76 such that there is a gap between opening 76 and the upper portion of elongated stem 44. Flexible downwardly angled periphery 40 extends beyond opening 76, thereby keeping head 38 above opening 76. This flexible downwardly angled periphery 40 of head 38 provides sufficient biasing so that a periphery of base 46 is predisposed upward and against the circumference of vent opening 28, thereby sealing vent opening 28, as seen in FIG. 1A.

When a vacuum is not being pulled, flexible periphery 56 of evacuation valve 50 covers and seals off satellite openings 32 (and/or the portion of evacuation opening 30 that extends beyond stem 52 and stopper 54), and base 46 covers and seals vent opening 28, as seen in FIG. 1A. A vacuum hose (not shown), attached to a vacuum source (also not shown), is place over vacuum port opening 78 to initiate the evacuation process. When a vacuum is pulled through vacuum port opening 78, flexible periphery 56 of evacuation valve 50 is lifted away from bottom 26 to allow air to be evacuate through satellite openings 32 (and/or through a portion of evacuation opening 30 that extends beyond stem 52 and stopper 54). More specifically, air from within the canister (upon which the lid 10 is engaged) flows through satellite openings 32 (and/or through a portion of evacuation opening 30 that extends beyond stem 52 and stopper 54), travels around flexible periphery 56 into chamber 35, and travels out through vacuum port opening 78. After a vacuum if formed within the container, flexible periphery 56 of evacuation valve 50 covers satellite openings 32 (and/or the portion of evacuation opening 30 that extends beyond stem 52 and stopper 54), while base 46 of vacuum release valve 36 continues to seal vent opening 28, thereby retaining the vacuum formed in the container.

In accordance with an embodiment of the present invention, flexible periphery 56 is urged downward when the vacuum hose stops pulling air from the canister (either because the vacuum source is turned off, or because no additional vacuum is being pulled) and the ambient pressure becomes greater than the pressure within the canister. At this point, bottom surface of flexible periphery 56 contacts an upper surface of housing bottom 26. As best seen in FIG. 4C, in accordance with an embodiment of the present invention, evacuation valve 56 is designed such that flexible periphery surface 56 substantially flattens out when the pressure within the canister is sufficiently less than the ambient pressure. As can also be seen in FIG. 4C, at this point valve stem 52 of evacuation valve 50 rests lower in evacuation valve opening 30 of housing bottom 26.

In order to release the vacuum within the canister, head 38 of vacuum release valve 36 is pushed downward to break the seal and contact area between the circumference of vent opening 28 and base 46 of vacuum release valve 36, as seen in FIG. 1B. The lower portion of elongated stem 44 and the upper portion of base 46 have a circumference that is smaller than the circumference of vent opening 28. This results in a gap between vacuum release valve 36 and vent opening 28 when vacuum release valve is pushed 36 down. When this gap is formed, ambient air rushes into the container through vacuum port opening 78, through chamber 35, and then through the gap formed between vacuum release valve and vent opening 28.

In accordance with an embodiment of the present invention, a slot or hole (not shown) is defined through periphery 40 of release valve head 38. Such a hole or slot provides an additional and/or alternative path through which ambient air can enter a canister during venting.

As mentioned above, cover member 58 and housing 20 are most likely manufactured of plastic, and valves 50 and 36 are each most likely manufactured from a rubber and/or elastomeric material. In accordance with an embodiment of the present invention, cover member 58, housing 20, evacuation valve 50 and vacuum release valve 36, are each integrally formed parts. An advantage of such an embodiment is that canister lid 10 can include as little at four separate pieces or parts, namely, cover member 58, housing 20, evacuation valve 50 and vacuum release valve 36. This results in a relatively simple canister lid 10. This also results in a canister lid l for which the parts are relatively inexpensive to manufacture and assemble. However, even though it is preferred that each of these parts are integrally formed, it is within the spirit and scope of the present invention that one or more of these parts can be include sub-parts.

The forgoing description is of the preferred embodiments of the present invention. These embodiments have been provided for the purposes of illustration and description, but are not intended to be exhaustive or to limit the invention to the precise forms disclosed. Many modifications and variations will be apparent to a practitioner skilled in the art. Embodiments were chosen and described in order to best describe the principles of the invention and its practical application, thereby enabling others skilled in the art to understand the invention. It is intended that the scope of the invention be defined by the following claims and their equivalents.

We claim:

1. A canister lid, comprising:

a cover member adapted to cover a canister, thereby defining an interior of the canister;

a housing attached to an underside of said cover member, wherein a chamber is defined by an interior of said housing and said underside of said cover member;

a first opening and a second opening in said cover member, which provide access into said chamber through said cover member;

a third opening and a fourth opening in a bottom of said housing, which provide access from the interior of the canister into said chamber through said bottom of said housing;

at least one satellite opening, in said bottom of said housing, near said fourth opening;

an evacuation valve including a stem portion and a top portion having a flexible periphery that extends beyond said stem portion, said stem fitting into said fourth opening such that said flexible periphery covers each of said at least one satellite opening;

and a vacuum release valve including a head that extends above said first opening, a base that extends below said third opening, and an elongated stem that extends between said head and said base, said head including a flexible downwardly angled periphery that extends beyond said first opening, thereby keeping said head above said first opening, said base having a periphery that extends beyond said third opening;

wherein said flexible downwardly angled periphery of said head of said vacuum release valve provides sufficient biasing so that said periphery of said base is predisposed upward against a circumference of said third opening, thereby sealing said third opening;

wherein a rounded rib resides on a terminal end of said flexible downwardly angled periphery such that said rounded rib acts as a fulcrum to assist in bending of said flexible downwardly angled periphery.

2. The canister lid of claim 1, wherein said flexible downwardly angled periphery flexes when a downward force is applied to said head of said vacuum release valve, thereby causing said base to moved downward and a gap to form between the third opening and said vacuum release valve.

3. The canister of claim 2, wherein a lower portion of said elongated stem just above said base has a circumference that is smaller than said third opening.

4. The canister of claim 2, wherein the gap allows air to enter the interior of the canister when pressure within the interior of the canister is lower than ambient pressure.

5. The canister of claim 1, wherein said third opening is substantially aligned with said first opening.

6. The canister of claim 1, wherein when a vacuum is pulled through said second opening, said flexible periphery of said evacuation valve is lifted away from said bottom of said housing to allow air to be evacuated through said at least one satellite opening, around said flexible periphery, into said chamber, and out through said second opening.

7. The canister of claim 6, wherein said flexible periphery of said evacuation valve covers each of said at least one satellite opening after a vacuum is formed in the interior of the canister.

8. The canister of claim 6, wherein said flexible periphery of said evacuation valve, covering each of said at least one satellite opening, and said base of said vacuum release valve, sealing said third opening, retains the vacuum formed in the canister.

9. The canister of claim 1, wherein the cover member includes an outer periphery adapted to engage a peripheral edge of a canister.

10. The canister lid of claim 1, wherein said head, base and elongated stem of said vacuum release valve are integrally formed.

11. The canister lid of claim 10, wherein said vacuum release valve is made of rubber.

12. The canister lid of claim 10, wherein said vacuum release valve is made of an elastomeric material.

13. The canister lid of claim 1, wherein said cover member, said housing, said vacuum release valve and said evacuation valve are each integrally formed.

14. An evacuation and venting assembly, comprising:

a cover member;

a housing attached to an underside of said cover member, wherein a chamber is defined by an interior of said housing and said underside of said cover member;

a first opening and a second opening in said cover member, which provide access into said chamber through said cover member;

a third opening and a fourth opening in a bottom of said housing, which provide access into said chamber through said bottom of said housing;

at least one satellite opening, in said bottom of said housing, near said fourth opening;

an evacuation valve including a stem portion and a top portion having a flexible periphery that extends beyond said stem portion, said stem fitting into said fourth opening such that said flexible periphery covers each of said at least one satellite opening;

and a vacuum release valve including a head that extends above said first opening, a base that extends below said third opening, and a stem that extends between said head and said base, said head including a flexible periphery that extends beyond said first opening, thereby keeping said head above said first opening, said base having a periphery that extends beyond said third opening;

wherein said flexible periphery provides sufficient biasing so that said periphery of said base is predisposed upward against a circumference of said third opening;

wherein a rounded rib resides on a terminal end of said flexible periphery such that said rounded rib acts as a fulcrum to assist in bending of said flexible downwardly angled periphery.

15. The canister lid of claim 1, wherein a raised portion resides on an exterior of said cover member and said raised portion surrounds said first and second openings, and wherein a first angle between an underside of said flexible downwardly angled periphery and said raised portion is between about 30° and about 60° and wherein a second angle between an inner surface of said rounded rib and raised portion is less than the first angle.

16. The canister lid of claim 1, wherein said first angle is 40°.

17. The assembly of claim 14, wherein said cover member, said housing, said vacuum release valve and said evacuation valve are each integrally formed.

18. A canister lid, comprising:

a cover member adapted to cover a canister, thereby defining an interior of the canister;

a housing attached to an underside of said cover member, wherein a chamber is defined by an interior of said housing and said underside of said cover member;

an evacuation valve adapted to selectively allow evacuation of the interior of the container;

and a vacuum release valve including a head that projects above said cover member, a base that extends below a vent opening in said housing, and an elongated stem that extends between said head and said base through said chamber, said vacuum release valve adapted to selectively allow venting of the interior of the container, and wherein said head includes a flexible periphery that provides sufficient biasing so that said base is predisposed to seal said vent opening, and wherein a rounded rib resides on a terminal end of said flexible periphery such that said rounded rib acts as a fulcrum to assist in bending of said flexible periphery.

19. The canister lid of claim 18, wherein said flexible downwardly angled periphery flexes when a downward force is applied to said head of said vacuum release valve, thereby causing said base to moved downward and a gap to form between the vent opening and said vacuum release valve.

20. The canister lid of claim 19, wherein a lower portion of said elongated stem just above said base has a circumference that is smaller than said vent opening.

21. The canister lid of claim 19, wherein the gap allows air to enter the interior of the canister when pressure within the interior of the canister is lower than ambient pressure.

22. The canister lid of claim 18, wherein when a vacuum is pulled through a vacuum port opening in said cover member, a flexible periphery of said evacuation valve is lifted away from a bottom of said housing to allow air to be evacuated through at least one satellite opening, around said flexible periphery, into said chamber, and out through said vacuum port opening.

23. The canister lid of claim 22, wherein said flexible periphery of said evacuation valve covers each of said at least one satellite opening after a vacuum is formed in the interior of the canister.

24. The canister lid of claim 23, wherein said flexible periphery of said evacuation valve, covering each of said at least one satellite opening, and said base of said vacuum release valve, sealing said vent opening, retains the vacuum formed in the canister.

25. The canister lid of claim 18, wherein the cover member includes an outer periphery adapted to engage a peripheral edge of a canister.

26. The canister lid of claim 18 wherein said head, base and elongated stem of said vacuum release valve are integrally formed.

27. The canister lid of claim 26, wherein said vacuum release valve is made of rubber.

28. The canister lid of claim 26, wherein said vacuum release valve is made of an elastomeric material.

29. The canister lid of claim 18 wherein said cover member, said housing, said vacuum release valve and said evacuation valve are each integrally formed.

30. A canister lid, comprising:

a cover member adapted to cover a canister, thereby defining an interior of the canister;

a housing attached to an underside of said cover member, wherein a chamber is defined by an interior of said housing and said underside of said cover member;

a first opening and a second opening in said cover member, adapted to provide access into said chamber through said cover member;

a third opening and a fourth opening in a bottom of said housing, adapted to provide access from the interior of the canister into said chamber through said bottom of said housing;

an evacuation valve including a stem portion and a top portion having a flexible periphery that extends beyond said stem portion, said stem fitting into said fourth opening such that said flexible periphery extends beyond said fourth opening;

and a vacuum release valve including a head that extends above said first opening, a base that extends below said third opening, and an elongated stem that extends between said head and said base, said head including a flexible downwardly angled periphery that extends beyond said first opening, thereby keeping said head above said first opening, said base having a periphery that extends beyond said third opening;

wherein said flexible downwardly angled periphery of said head of said vacuum release valve provides sufficient biasing so that said periphery of said base is predisposed upward against a circumference of said third opening, thereby sealing said third openings;

wherein a rounded rib resides on a terminal end of said flexible downwardly angled periphery such that said rounded rib acts as a fulcrum to assist in bending of said flexible downwardly angled periphery.

31. An evacuation and venting assembly, comprising:

a cover member;

a housing attached to an underside of said cover member, wherein a chamber is defined by an interior of said housing and said underside of said cover member;

a first opening and a second opening in said cover member, adapted to provide access into said chamber through said cover member;

a third opening and a fourth opening in a bottom of said housing, adapted to provide access into said chamber through said bottom of said housing;

an evacuation valve including a stem portion and a top portion having a flexible periphery that extends beyond said stem portion, said stem fitting into said fourth opening such that said flexible periphery extends beyond said fourth opening;

and a vacuum release valve including a head that extends above said first opening, a base that extends below said third opening, and a stem that extends between said head and said base, said head including a flexible periphery that extends beyond said first opening, thereby keeping said head above said first opening, said base having a periphery that extends beyond said third opening;

wherein a rounded rib resides on a terminal end of said flexible periphery such that said rounded rib acts as a fulcrum to assist in bending of said flexible periphery.

32. An evacuation and venting assembly, comprising:

a cover member;

a housing attached to an underside of said cover member, wherein a chamber is defined by an interior of said housing and said underside of said cover member;

a first opening and a second opening in said cover member, adapted to provide access into said chamber through said cover member;

a third opening and a fourth opening in a bottom of said housing;

an evacuation valve including a stem portion and a top portion having a flexible periphery that extends beyond said stem portion, said stem fitting into said fourth opening such that said flexible periphery extends beyond said fourth opening;

and a vacuum release valve including a head that extends above said first opening, a base that extends below said third opening, and an elongated stem that extends between said head and said base, said head including a flexible downwardly angled periphery that extends beyond said first opening, thereby keeping said head above said first opening, said base having a periphery that extends beyond said third opening;

wherein said flexible downwardly angled periphery of said head of said vacuum release valve provides sufficient biasing so that said periphery of said base is predisposed upward against said third opening, thereby sealing said third opening;

wherein a rounded rib resides on a terminal end of said flexible downwardly angled periphery such that said rounded rib acts as a fulcrum to assist in bending of said flexible downwardly angled periphery.

* * * * *